United States Patent [19]

Kruse

[11] Patent Number: 4,543,015

[45] Date of Patent: Sep. 24, 1985

[54] PILE HAVING WEDGE FORMER

[76] Inventor: William E. Kruse, 1009 Hillside Ave., Plainfield, N.J. 07060

[21] Appl. No.: 532,210

[22] Filed: Sep. 14, 1983

[51] Int. Cl.[4] ..... E02D 5/30; E02D 5/48

[52] U.S. Cl. ..... 405/256; 405/252; 405/253

[58] Field of Search ..... 405/232, 233, 243, 245, 405/251, 252, 253, 254, 255, 256, 257, 242

[56] References Cited

U.S. PATENT DOCUMENTS

| | | | |
|---|---|---|---|
| 975,488 | 11/1910 | Welsh . | |
| 975,514 | 11/1910 | Cummings . | |
| 1,490,532 | 4/1924 | Guyotte . | |
| 1,778,925 | 10/1930 | Thornley . | |
| 1,836,140 | 12/1931 | Upson . | |
| 1,893,011 | 1/1933 | Watt . | |
| 2,036,793 | 4/1936 | Christie | 405/250 |
| 2,057,310 | 10/1936 | Prielipp | 405/232 |
| 2,187,316 | 1/1940 | Greulich . | |
| 2,187,318 | 1/1940 | Greulich . | |
| 2,371,784 | 3/1945 | Titcomb . | |
| 2,428,070 | 9/1947 | Frenkil | 405/250 X |
| 2,554,896 | 5/1951 | Caudill . | |
| 3,012,644 | 12/1961 | Bush . | |
| 3,279,136 | 10/1966 | Smith . | |
| 3,362,171 | 1/1968 | Arpaia . | |
| 3,751,931 | 8/1973 | Merjan . | |
| 3,763,655 | 10/1973 | Calusca . | |
| 3,779,025 | 12/1973 | Godley . | |
| 3,971,227 | 7/1976 | Godley . | |
| 4,047,389 | 9/1977 | Yang . | |
| 4,349,298 | 9/1982 | Kruse . | |

FOREIGN PATENT DOCUMENTS

| | | | |
|---|---|---|---|
| 683820 | 4/1964 | Canada | 405/252 |
| 730986 | 1/1943 | Fed. Rep. of Germany . | |
| 112517 | 7/1982 | Japan | 405/250 |
| 33562 | 9/1934 | Netherlands . | |
| 34868 | 3/1935 | Netherlands . | |
| 78814 | 8/1955 | Netherlands . | |
| 28269 | of 1907 | United Kingdom . | |
| 424257 | 2/1935 | United Kingdom . | |

OTHER PUBLICATIONS

Pile Foundations–Author: Chellis.

"The Ultimate Bearing Capacity of Wedge Shaped Foundations" Author: Meyerhoff.

"New Pile Appears on Boston Waterfront"–Construction Methods and Equipment, May 1957.

*Primary Examiner*—Dennis L. Taylor

*Assistant Examiner*—Nancy J. Stodola

*Attorney, Agent, or Firm*—Mandeville and Schweitzer

[57] ABSTRACT

A new pile is disclosed which includes a pile shaft and wedge-forming means of castable material spaced upward of the tip of the pile shaft and proximate thereto. The wedge-forming means cooperates with the portion of the pile beneath it, during driving, to cause the formation of a wedge of soil. The thus-formed soil wedge is in contact with other soil and the resulting soil-soil interface has enhanced pile supporting characteristics.

32 Claims, 8 Drawing Figures

PILE HAVING WEDGE FORMER

BACKGROUND AND SUMMARY OF THE INVENTION

In present commercial practice, when dense soils or bedrock are at moderate depths, steel "H" section piles, precast piles, or pipe piles may be driven to these soils or rock. In this way, static load capacities in excess of 80 tons are achieved. Since these piles derive their principal support at their tip, they are best categorized as "end bearing piles."

However, there are numerous conditions in which pile design permits piles to be successfully driven into granular or cohesive soils, or mixtures thereof, for the supporting of those piles. In such situations, the piles distribute their load by a combination of friction forces acting along the side of the pile and by "end bearing" forces acting beneath the tip of the pile. These piles may be steel "H" piles, precast piles, pipe piles, or mandrel-driven shell piles and are best denominated "friction piles."

Frequently a soil profile is encountered wherein unsuitable soils, i.e., those which will compress or consolidate excessively, are underlain by bearing soils which are of only moderate or low density. While conventional "friction piles" might ultimately achieve adequate penetration for support in such soil, the depth of penetration required may be such that it can be achieved much more economically with the new and improved piles of the present invention. In accordance with the invention, a less expensive pile is provided which can be driven with greater facility through intervening layers, if any, of semi-suitable soils to the ultimate bearing layer without recourse to the time-consuming and costly special methods which heretofore might be required for state of the art types of piles.

As has been described by G. G. Meyerhof in a thesis entitled "The Ultimate Bearing Capacity of Wedge-Shaped Foundations," the ultimate bearing capacity of a foundation may be markedly increased by using a wedge of shallow depth and making the wedge of a rough surface, e.g. concrete. Numerous prior art pile devices have made use of this fundamental general "wedge" principle. The Raymond "Standard Pile," which is heavily tapered, embodies this principle. Monotube piles utilize a variety of taper configurations in conformity with this principle. Likewise, Franki piles, which are in a sense an "in situ" spread footing, nevertheless embody this wedge theory. Indeed, this general concept has also been utilized by positioning a structural, wedge-shaped mass, of larger area than the pile, at the tip (very bottom) of the pile as described in Merjan Pat. No. 3,751,931.

The present invention is directed to certain pile structures in which substantial advantages are derived from positioning a new wedge-forming structure spaced from the tip of the pile.

The principle upon which the present invention is predicated is that the frictional value betwen soil and soil is higher than that between steel and soil or concrete and soil. Accordingly, a soil-soil interface results in the highest value of support. This concept has been applied in a different fashion in prior art piles. For example, the concept is demonstrated by the increased capacity of corrugated shell piles versus smooth-sided pipe piles of the same length and diameter. The higher capacity of the shell results from the fact that the soil is locked in the valleys of the shell corrugations. Hence, the mode of failure is a function of the sheer strength of the soil rather than the friction between steel and soil, the former being a much higher value. Another example is found in steel "H" piles. It is well known that soil "locks" between the flanges and against the web of such piles. The locked soil results in a mode of support based on the frictional value between soil and soil.

The new and improved pile of the present invention employs a "wedge-forming element" or "wedge-former" which is spaced upwardly on the pile shaft from the tip rather than forming an actual wedge at the very tip. As a result of this unique positioning of a new "wedge-former" on the pile, during driving of the pile soil is forced to form in situ a soil wedge and to interface with other soil as the pile is driven to its ultimate depth. Specifically, soil collects under the shoulder and the tapered outer wall of the "wedge-former" and is, in effect, "locked" into the "wedge-former" (between the "wedge-former" and the shaft of the pile). The locked soil functions as a true wedge against other soil and it is this soil-soil effect which makes the new pile particularly advantageous, since, as discussed above, the frictional value between soil and soil is higher than that between steel and soil or concrete and soil. For this reason, the "soil wedge" formed in situ about the new pile provides a higher value of support at shallower driven depths than that found in earlier piles.

Because the soil wedge formed in accordance with the principles of the invention enables the pile to mobilize the soil's resistance more efficiently than known piles, the new pile need not be so massive as the Franki-type pile or the Merjan-type precast wedge tips. Hence, it lends itself to installation more economically (with conventional pile driving equipment and often to lesser depths) in a large range of soil conditions. Furthermore, the wedge-forming piles of the present invention are superior to the massive, precast concrete type of piles with integral wedges in that the new piles may more readily be driven through layers of semisuitable soils to the ultimate bearing layer without recourse to time-consuming and costly methods such as jetting or predrilling. Also, the new and improved piles of the invention avoid the uncertainties inherent in the formation of Franki-type piles, each of which is constructed according to a variety of guidelines furnished for implementation at the site. The new pile may be driven with impact pile hammers having energies in the range of approximately 15,000 to 36,000 ft.-lbs, per blow and the size of the retaining device may be readily varied to suit soil/-load/hammer interrelationships.

The piles of the present invention may take any of several preferred forms. For instance, the "wedge-former" may be in the form of a truncated cone of precast concrete inserted onto a pipe pile and attached at an appropriate place thereon. Alternatively, the shaft and wedge-former may be integrated in the form of a unitary concrete pile. Or, in a particularly advantageous embodiment, a precast concrete point which includes an appropriately positioned wedge-former and a short section of pipe cast into its upper portion may be employed. In using this embodiment, the point is first planted into the ground. Then, the remainder of the pipe pile is connected to the section of pipe which was cast in the wedge and the pile is driven into the soil in the usual way.

It should be noted that the invention is not limited to the use of pipe piles; as will be apparent to those skilled in the art, other types of piles may be utilized. Similarly, the shape of the wedge may be varied somewhat for adaptation to different situations.

It is an object of this invention to provide a pile with improved penetration and superior support characteristics.

It is a further object of the invention to provide a pile which may be easily and economically driven into soil of inferior support quality.

For a more complete understanding of the above and other features and advantages of the invention, reference should be made to the following detailed description of preferred embodiments thereof and to the accompanying drawings.

DETAILED DESCRIPTION OF THE INVENTION

Figure 1:
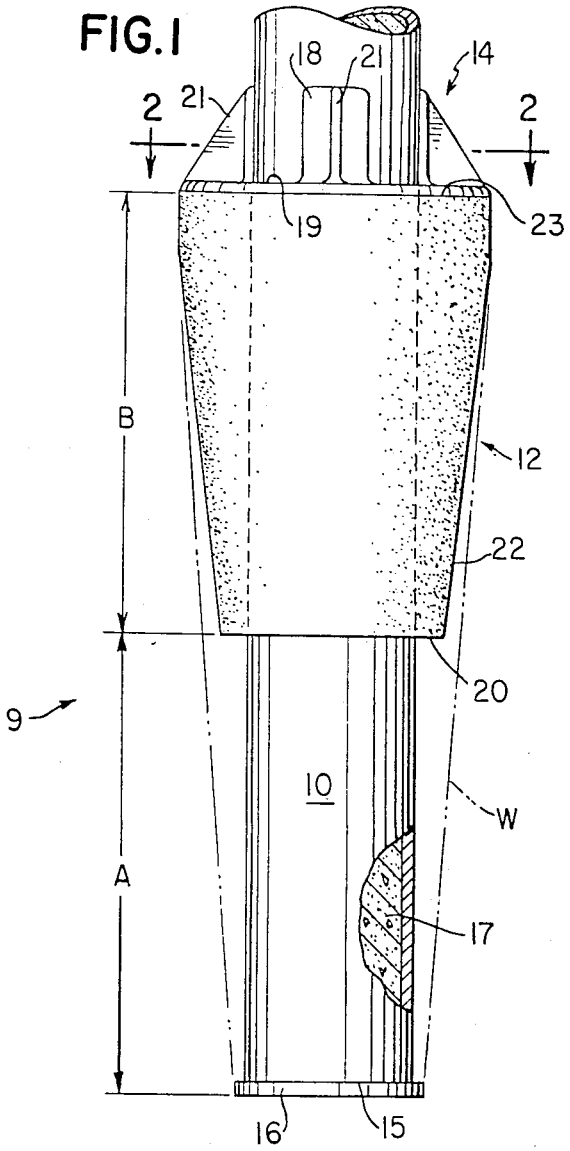
FIG. 1 is a side elevational view of a preferred embodiment of the invention including a precast concrete "wedge-former" in the form of a generally truncated cone retained on a pipe pile.

As illustrated in FIG. 1, a first preferred embodiment of a new pile 9 comprises an elongated pile shaft in the form of cylindrical pipe 10, a "wedge-former" 12 formed of a generally truncated cone of precast concrete, and a wedge-former mount 14 welded to the pile shaft. The pipe 10 is closed at its tip 15 by circular steel plate 16 welded thereto and filled with concrete 17, although in certain applications the plate 16 may be omitted for open ended driving.

The wedge-former mount 14 includes an annular retaining plate 19, vertical flanges 18, and radial webs 21 which cooperate to fasten the wedge former 14 to the pile shaft 10, a shown, in an ultimate wedge-forming position. The wedge-former 12 is fabricated from precast concrete or from any other castable material capable of withstanding the conditions encountered during driving. Concrete is generally preferred because of its rough surface. Similarly, although the shaft 10 is illustrated as a pipe, other pile shafts, such as those made of precast concrete, may advantageously be used.

The shapes of the wedge-formers of the invention may be varied depending upon the circumstances in which they are to be used. Of particular importance is that they be shaped to take advantage of the "locking" effect described earlier. In FIG. 1, the shoulder 20 and the tapered sides 22 of the wedge-former 12 function to lock the soil between the wedge-former 12 and the pile shaft, during driving. The locking effect results in the formation of a soil wedge "W" shown generally in phantom in FIG. 1, and extending from the tip 15 to the upper portions of the wedge-former 12. Because the soil wedge "W" contacts other soil, the high support value of a soil-soil interface is advantageously utilized. Furthermore, since the support value is so high, the wedge-former 12 need only be of modest size. Consequently, the new pile is less expensive to fabricate and is more easily driven through non-bearing soil layers.

The sizing of the elements of the new piles of the invention may vary in accordance with the soil environment in which they are to be used. By way of example, where nine-inch diameter, 30–40 lb./ft. load-bearing pipe pile shafts are to be used to support ultimate loads of 160 tons, the following dimensions would be appropriate for the pile of FIG. 1: the spacing "A" between the shoulder 20 and the tip 15 of the shaft 10 is 24 inches; the height "B" of the wedeg-former 12 from the top 23 to the shoulder 20 is 24 inches; and the diameter of the widest portion of the wedge-former 12 is 17 inches. It will be apparent that the height of the wedge-former of the invention will be quite small relative to the depth of the bearing layer. It is not necessary that the wedge-former accompany the pile shaft for a substantial distance to realize the advantageous results described herein. The ratio of the height of the wedge-former to the width of the pile shaft immediately below said wedge former may be 3.5:1 or less, preferably within the range of approximately 2:1 through approximately 3.5:1.

In operation, the wedge-former 12 may be fastened to the pile shaft 10 at any time prior to driving. The pile 9, with the wedge-former 12 affixed thereto, is driven by conventional techniques.

Figure 3:
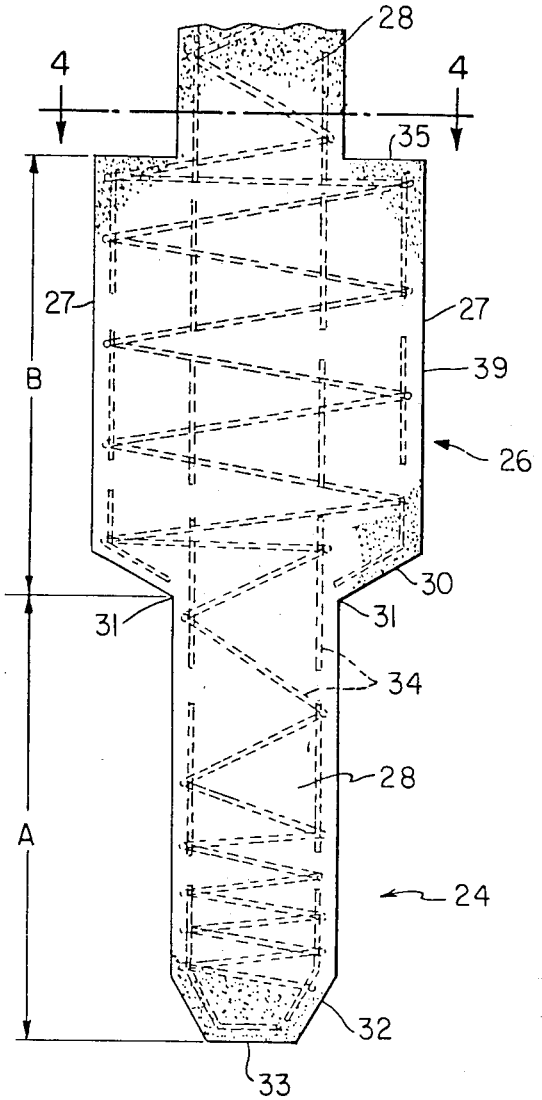
FIG. 3 is a vertical cross-sectional view of an alternate preferred embodiment of the invention including a precast pile and wedge-former.
Figure 2:
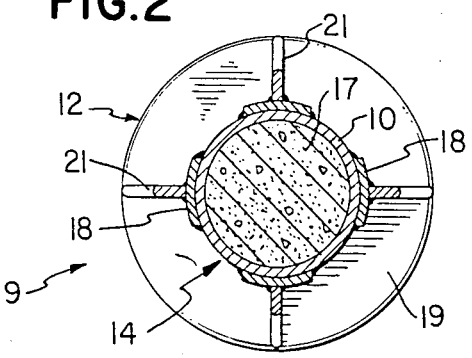
FIG. 2 is a cross-sectional view of the pile of FIG. 1, taken along the lines 2—2.
Figure 4:
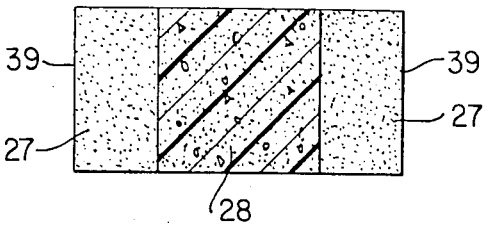
FIG. 4 is a cross-sectional view of the pile of FIG. 3 taken along lines 4—4 thereof.

An alternative embodiment of the invention is shown in FIG. 3. A precast concrete pile 24 is formed having a generally rectangular wedge-forming member 26 integral with the square shaft 28. In this form, the wedge-former is constructed as wings 27 on opposite sides of the pile shaft 28. As illustrated in FIG. 3, the wedge-former is discontinuous, i.e., it does not totally surround the pile shaft 28 of the pile 24. The thickness and the number of wings 27 is determined in accordance with the soil conditions in which the pile is to be used. The tapered base wall 30 of the wedge-former 26 functions with the lower part of the pile to cause, during driving, the formation of the soil wedge generally in the manner described hereinabove. Side wall 39 of the wedge-forming wing is substantially parallel to the pile shaft. The lower end 32 of the pile adjacent the tip 33 is tapered to facilitate penetration of the pile 24 into soil during driving. For greater strength, the concrete is provided with metal reinforcement members 34.

As noted above, the sizing of the piles of the invention may be varied, depending on the conditions in which they are to be used. By way of example, where nine inch diameter 30–40 lb./ft. load-bearing pile shafts are to be used to support ultimate loads of 160 tons, the following dimensions may be employed for the pile of FIG. 3: the spacing "A" between the base of the wedge-forming wing 31 and the tip 33 of the pile shaft is 24 inches; the distance "B" from the top wall of the wing 35 to the base of the wing 31 is 24 inches; and the length of the widest portion of the wedge-former is 18 inches. The ratio of the height of the wedge-former to the width of the pile shaft (i.e., the longer dimension of the cross section) immediately below said wedge former may be 3.5:1 or less, preferably within the range of approximately 2:1 through approximately 3.5:1.

Figure 5:
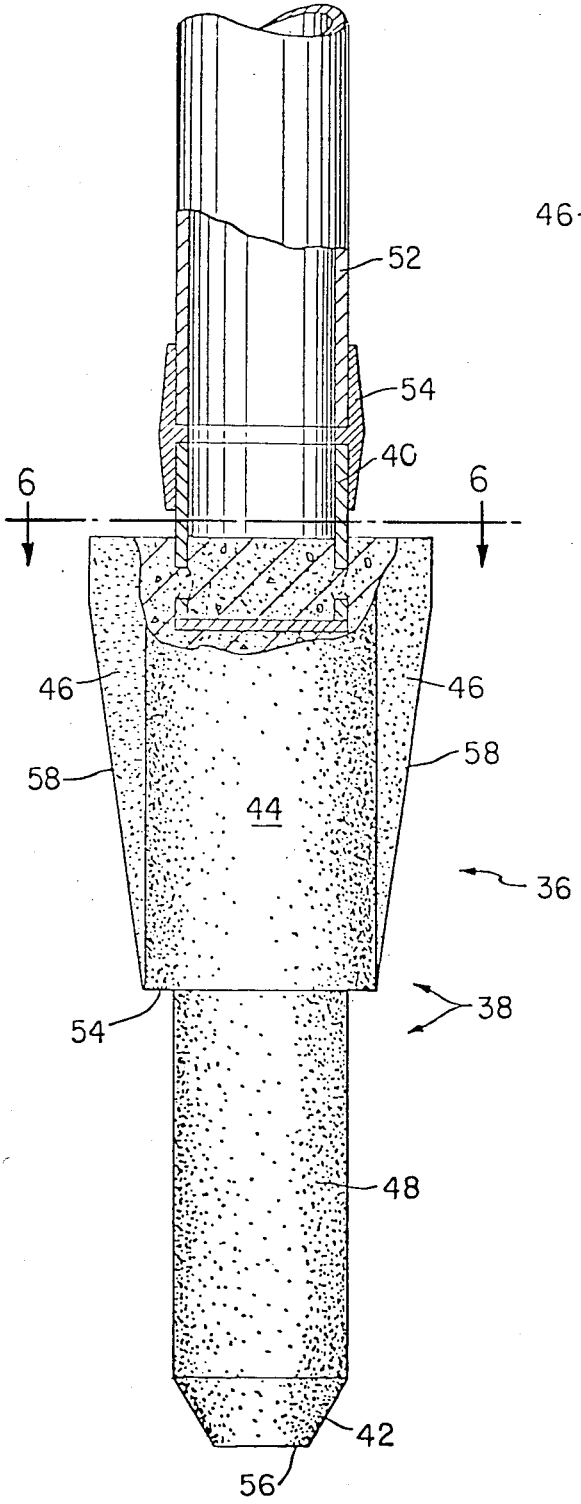
FIG. 5 is a front elevational view with parts broken away to show details of construction of another alternate preferred embodiment of the invention including a precast point attached to a pipe pile.
Figure 6:
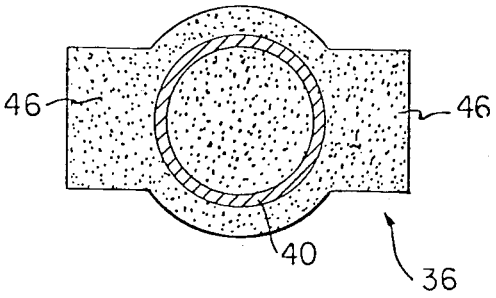
FIG. 6 is a cross-sectional view of the pile of FIG. 5 taken along the lines 6—6 thereof.

A particularly advantageous embodiment of the invention is depicted in the pile 36 shown in FIG. 5, which pile includes a concrete point 38 into which a short section of pipe 40 is cast. The point 38 has a central pile shaft 44 and, in its upper portions, the point includes a pair of wedge-forming wings 46 peripheral to the pile shaft. The wings include a shoulder 64 and inclined walls 58. The pile shaft extends downward in a columnar projection 48 appropriate for inserting the point into the ground. The wings 46 function in accordance with the principles of the invention generally in the same manner as the other wedge-formers already specifically mentioned. The soil is locked beneath the shoulders 64 and inclined walls 58 against the columnar projection 48. The locked soil forms a soil wedge in accordance with the invention. The concrete may be reinforced as in the other embodiments. The columnar projection may be tapered adjacent the tip 56, as at 42, to facilitate penetration of the soil.

In operation, the point 38 is first "planted" into the ground by driving on top of the short section of pipe 40. Then, a second section of pipe 52 is attached to the short section, as by welding or with a "drive fit" 54 (also known as a mechanical connector). The entire pile assembly (pipe plus point) may then be driven into the ground using conventional driving methods.

Figure 7:
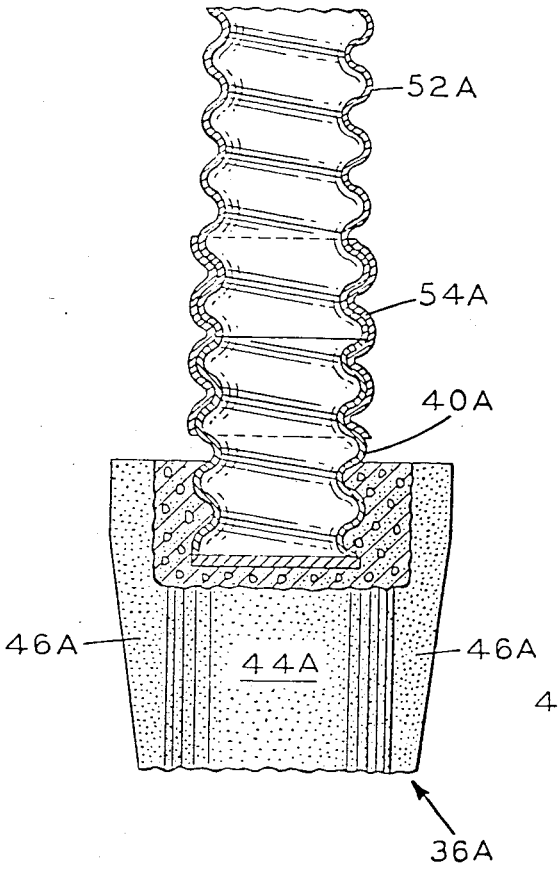
FIG. 7 is a partial cross sectional view of the alternate preferred embodiment of the invention wherein the pile cast into the concrete point is a shell pile.
Figure 8:
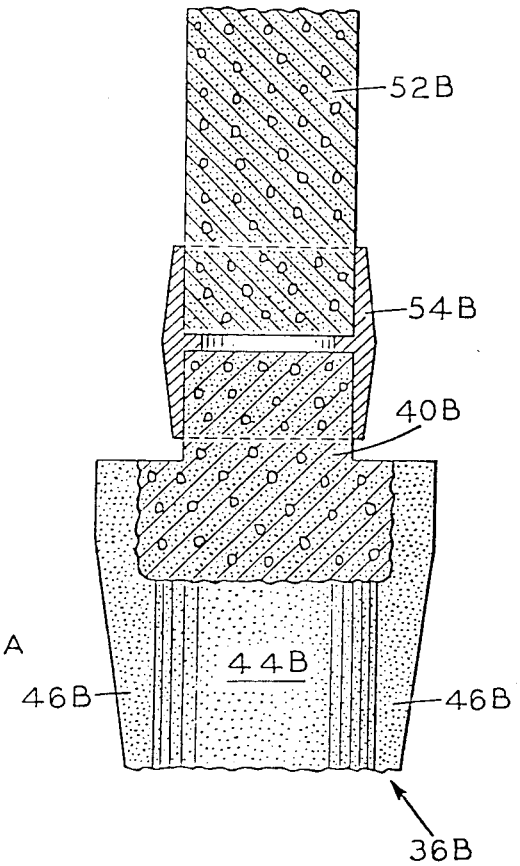
FIG. 8 is a partial cross sectional view of the alternate preferred embodiment of the invention, wherein the pile cast into the concrete point is composed of precast concrete.

Other types of pile shafts (other than pipes) may also be employed in association with the embodiment of FIG. 5. For instance, mandrel driven shells and precast piles may be employed in lieu of pipes. FIG. 7 illustrates a pile 36A in which the short section of pile cast into the concrete point 44A is shell pile 40A. A mechanical connector 54A connects the cast section 40A of shell pile to a second section 52A of shell pile. FIG. 8 illustrates a pile 36B in which the short section of pile cast into the concrete point 44B is precast concrete 40B. A mechanical connector 54B connects the cross section 40B of precast concrete pile to a second section 52B of precast concrete pile. The wings 46A and 46B in FIGS. 7 and 8, respectively, function in accordance with the principles of the invention generally in the same manner as the other wedge formers already mentioned. The embodiments of FIGS. 7 and 8 are both used generally in the manner described for the embodiment of FIG. 5.

It should be understood that the specific forms of the invention herein illustrated and described are intended to be representative only. Changes, including but not limited to, those suggested in this specification, may be made in the illustrated embodiments without departing from the clear teachings of the disclosure. Accordingly, reference should be made to the following appended claims in determining the full scope of the invention.

I claim:

1. A wedge-forming pile which comprises:

(a) an elongated pile shaft having a bottom tip and an upper end and (b) wedge-forming means of castable material spaced upward of the tip of the pile shaft and proximate to said tip, (c) said pile shaft extending above and below said wedge-forming means, (d) the minimum combined width of said pile shaft and accompanying wedge-forming means from side wall to said wall being greater than the width of said pile shaft immediately above said wedge-forming means and greater than the width of said pile shaft immediately below said wedge-forming means, (e) the ratio of the height of said wedge-forming means to the width of said pile shaft immediately below said wedge-forming means being within the range of 2:1 through 3.5:1, (f) whereby the outer portions of said tip, said wedge-forming means and the portions of the pile shaft therebetween accommodate the formation of a soil wedge during driving of said pile.

2. The wedge-forming pile of claim 1, wherein the pile shaft is a pipe pile.

3. The wedge-forming pile of claim 1, wherein the pile shaft is a concrete pile.

4. The wedge-forming pile of claim 1, wherein the pile shaft is of circular cross-section.

5. The wedge-forming pile of claim 1, wherein the pile shaft is of rectangular cross section.

6. The wedge-forming pile of claim 1, wherein the castable material of which the wedge-forming means is made is concrete.

7. The wedge-forming pile of claim 1

(a) wherein the wedge-forming means includes a truncated cone of castable material, (b) said pile further including mounting means for attaching said cone to the pile shaft.

8. The wedge-forming pile of claim 1, wherein the wedge-forming means and the pile shaft are an integral concrete unit.

9. The wedge-forming pile of claim 6, wherein (a) the wedge-forming means comprises at least one wing having a base wall, vertical side walls and a top wall, (b) said top wall extending radially outward from the pile shaft, (c) said vertical side walls extending downwardly from said top wall generally parallel with the axis of said pile shaft, (d) said base wall extending downwardly and inwardly from at least one of said side walls toward the pile shaft to the base of said wing, (e) said side walls terminating at the edges of said base wall.

10. The wedge-forming pile of claim 1, wherein (a) the lower end of the pile shaft and the wedge-forming means comprise an integral point of castable material, and (b) said pile shaft further includes a section of pile cast into the upper end of said point.

11. The wedge-forming pile of claim 10, wherein the cast section of pile is pipe pile.

12. The wedge-forming pile of claim 10, wherein the cast section of pile is shell pile.

13. The wedge-forming pile of claim 10, wherein the cast section of pile is precast-concrete pile.

14. The wedge-forming pile of claim 10, wherein the castable material of which the point is made is concrete.

15. The wedge-forming pile of claim 8, wherein (a) said wedge-forming means has a shoulder extending downwardly generally perpendicular to said shaft, (b) an inclined wall extending outwardly up from the shoulder, and (c) a top wall which is longer than the shoulder and extends from the end of the inclined wall to the shaft.

16. Wedge-forming pile according to claim 1, wherein the vertical distance between said tip and the base of said wedge-forming means is 24 inches, the height of the wedge former is 24 inches and the combined width of the pile shaft and the widest portion of the wedge former is 17 inches.

17. Wedge forming pile according to claim 1, wherein the diameter of said pile shaft is approximately the same above and below said wedge former.

18. Wedge-forming pile according to claim 1, wherein the distance from said tip to the base of the wedge forming means is substantially equivalent to the height of the wedge-forming means.

19. The pile of claim 1, wherein said ratio of the height of the wedge-forming means to the width of the pile shaft is above approximately 2.7:1 and not greater than 3.5:1.

20. The pile of claim 1, wherein said ratio of the height of the wedge-forming means to the width of the pile shaft is below approximately 2.7:1 and not less than 2:1.

21. The pile of claim 1, wherein the ratio of element (e) is 3:1 or above, but is not greater than 3.5:1.

22. The pile of claim 1, wherein the ratio of element (e) is 2.4:1 or below, but not less than 2:1.

23. The pile of claim 1, wherein the ratio of element (e) is 2.8:1 or above, but not greater than 3.5:1.

24. The pile of claim 1, wherein the ratio of element (e) is below 2.5:1, but not less than 2:1.

25. Pile of claim 1, wherein the bottom of said wedge forming means includes a shoulder which extends outwardly from said pile shaft.

26. Pile of claim 25, wherein said wedge former shoulder is perpendicular to said pile shaft.

27. Wedge forming pile of claim 10, wherein said wedge forming means includes at its bottom a shoulder.

28. The pile of claim 1, wherein the ratio of element (e) is within the range of from 2:1 to 3:1.

29. Pile of claim 1, wherein the wedge former comprises a precast truncated cone of castable material.

30. Pile of claim 29 produced by the process of inserting the precast wedge former onto the pile shaft and attaching the wedge former to the pile shaft.

31. Process of driving a pile which comprises (1) driving a wedge forming pile which includes (a) an elongated pile shaft having a bottom tip and an upper end and (b) wedge forming means of castable material spaced upward of the tip of the pile shaft and proximate to said tip, (c) said pile shaft extending above and below said wedge forming means, (d) the minimum combined width of said pile shaft and accompanying wedge forming means from side wall to side wall being greater than the width of said pile shaft immediately above said wedge forming means and greater than the width of said pile shaft immediately below said wedge forming means, (e) the ratio of the height of said wedge forming means to the width of said pile shaft immediately below said wedge forming means being within the range of 2:1 through 3.5:1, (f) whereby the outer portions of said tip, said wedge forming means and the portions of the pile shaft therebetween accomodate the formation of a soil wedge during driving of said pile.

32. Process of driving a pile according to claim 31, wherein the wedge former is a precast truncated cone of castable material and said process includes fastening said precast wedge former to the pile shaft and then driving said pile.

* * * * *